US005108212A

United States Patent [19]

Lee

[11] Patent Number: 5,108,212

[45] Date of Patent: Apr. 28, 1992

[54] MOUNTING SEAT FOR THE PAPER CLIPPING STRUCTURE OF A HARD COVER PAPER FILE

[76] Inventor: Ming-Ted Lee, No. 62, Lane 94, Wenlin N. Road, Pei-Tou, Taipei, Taiwan

[21] Appl. No.: 721,953

[22] Filed: Jun. 27, 1991

[51] Int. Cl.[5] ..... B42F 13/00

[52] U.S. Cl. ..... 102/75; 402/76; 402/37

[58] Field of Search ..... 402/72, 75, 76, 77; 102/29, 31, 36, 60; 281/45

[56] References Cited

U.S. PATENT DOCUMENTS

| | | | |
|---|---|---|---|
| 2,891,553 | 6/1959 | Acton | 402/76 |
| 3,322,129 | 5/1967 | Drysdale | 402/75 |
| 4,453,850 | 6/1984 | Purcocks | 402/75 |
| 4,591,187 | 5/1986 | Jeanson et al. | 402/75 X |
| 4,941,804 | 7/1990 | Sarpy, Jr. | 402/75 |

FOREIGN PATENT DOCUMENTS

| | | | |
|---|---|---|---|
| 914588 | 1/1963 | United Kingdom | 402/77 |
| 1264515 | 2/1972 | United Kingdom | 402/76 |

*Primary Examiner*—Timothy V. Eley
*Assistant Examiner*—William Fridie, Jr.
*Attorney, Agent, or Firm*—Bacon & Thomas

[57] ABSTRACT

A structure for the mounting seat of a paper-file hard cover. The mounting seat is substantially a narrow plates having screw hole and fastening plate being provided at the end thereof. The four corners of the plate are respectively provided with hollow tubular elements for the mounting of the hard cover which is firmly secured with tapered pegs. The paper-clipping structure is then mounted or fastened to the mounting seat by means of rivets of other fastening elements so that the mounting seat provides a structure for holding paper.

3 Claims, 5 Drawing Sheets

MOUNTING SEAT FOR THE PAPER CLIPPING STRUCTURE OF A HARD COVER PAPER FILE

BACKGROUND OF THE INVENTION

The present invention relates to a mounting seat for the paper-clipping structure of a paper file, and in particular, to a mounting seat having screw holes and fastening means at the opposite ends thereof to securely mount the paper-clipping structure to the seat, and at the same time the hard cover of the file can be mounted and secured to the mounting seat at the corners thereof by tapered pegs.

Generally, conventional paper-clipping structures are either provided with a screw hole at both the opposite ends thereof or with fastening means at the rear side of the paper-clipping structure and then mounted with hard cover type of file. However, the combinations of such paper-clipping structure and mounting seat are different from each another.

In the conventional mounting seat in the form of a thin metallic plate, four holes are provided on the plate. Both of the holes nearest to the terminal of the plate are mounted to the hard cover of a file. The other two holes are aligned with the holes at the terminal of the paper-clipping structure, thus corresponding to the holes of the mounting seat for receiving rivets. The paper-clipping structure and the mounting seat are combined together by means of a male and female fastening assembly. This method has a drawback in that mechanical means must be used in combining the paper-clipping structure and the mounting seat. Thereafter, material such as leather, fabric, etc. may be used to cover the mounting seat so as to present an aesthetic appearance. However, since the flexural strength of the hard cover is limited, the rivets may be dislocated after a period of using the file. This will cause the dislocation of the paper-clipping structure and the mounting seat. Similarly, for those paper-clipping structures having fastening means mounted at the rear surface thereof, an insecure mounting is realized. As a result, after a considerable period of use, the mounting seat may be dislocated after frequent impact with files or similar articles.

SUMMARY OF THE INVENTION

Accordingly, it is an object of the present invention to provide an improved structure for the mounting seat of a paper file hard cover which is simple in structure and economical to manufacture.

It is another object of the present invention to provide an improved structure for the mounting seat of a paper file hard cover in which the paper-clipping structure will not be dislocated from the mounting seat after a long period of use.

It is yet another object of the present invention to provide an improved structure for the mounting seat of a paper file hard cover which allows combining with a paper-clipping structure having holes at both ends thereof.

It is a further object of the present invention to provide an improved structure for the mounting seat of a paper file hard cover which may be combined with a paper-clipping structure having fastening means mounted at the rear surface thereof.

These and other objects, advantages and features of the present invention will be more fully understood and appreciated by reference to the detailed description.

BRIEF DESCRIPTION OF THE DRAWINGS

The present invention will be further explained with reference to the annexed drawings, wherein.

DETAILED DESCRIPTION OF THE INVENTION

Figure 1:
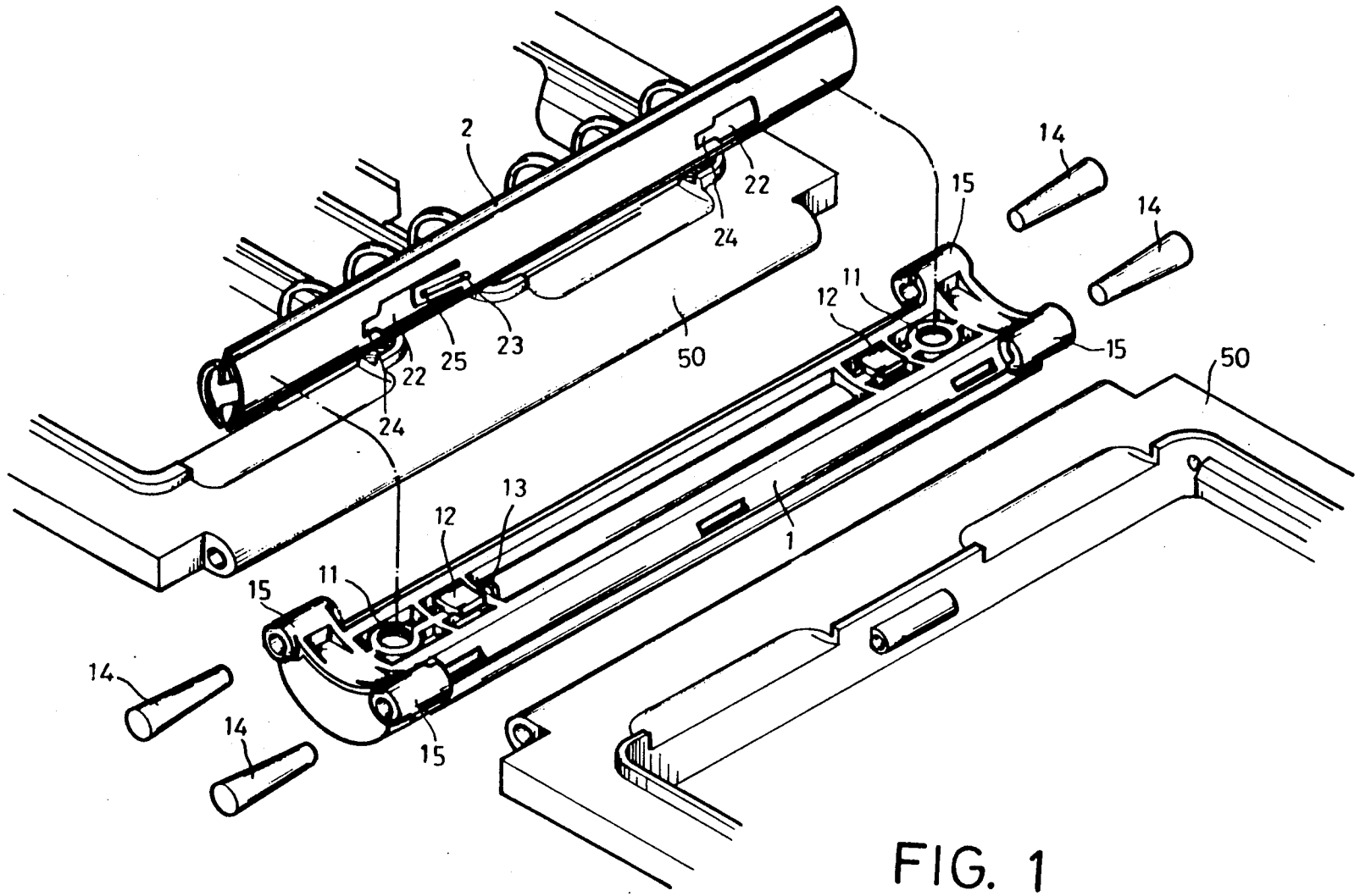
FIG. 1 is a perspective exploded view of the mounting seat with the paper-clipping structure having fastening means, in accordance with the present invention.
Figure 2:
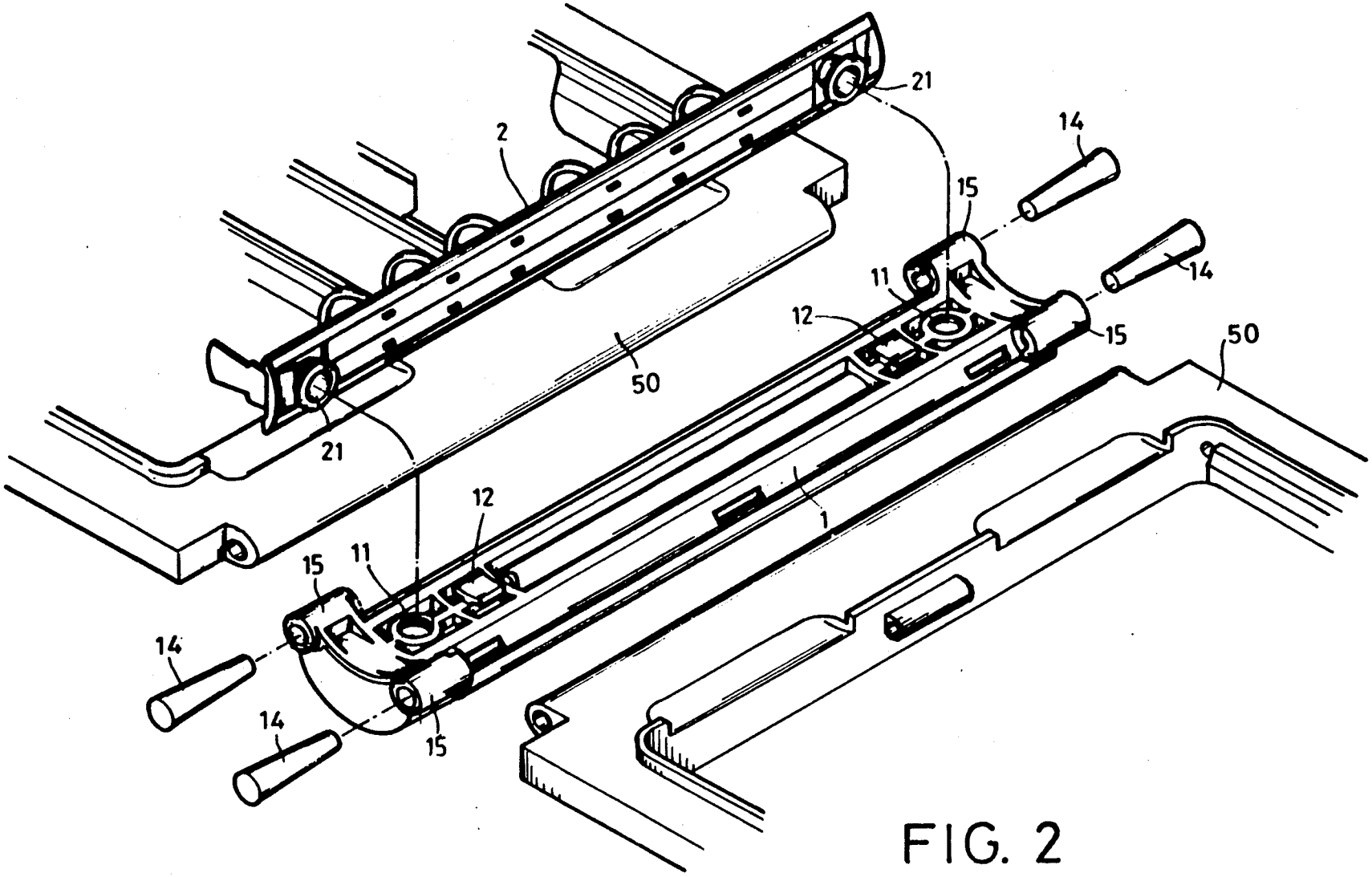
FIG. 2 is a perspective exploded view of the mounting seat with the paper-clipping structure having a screw hole at each opposite thereof, in accordance with the present invention.

Referring to FIGS. 1 and 2, there is shown the mounting seat 1 in the form of a substantially narrow plate being provided with a screw hole 11 at each of the end portions along the axis thereof. Adjacent to each hole 11 a fastening plate 12 is respectively provided. A protrusion 13 is provided next to one fastening plate 12. Four hollow tubular elements 15 are provided at each of the corners and arranged axially to the mounting seat 1. The hard cover 50 of a file can be mounted to the mounting seat 1 by means of four tapered pegs 14 inserted through the tubular elements 15 and the hard cover 50.

Figure 3:
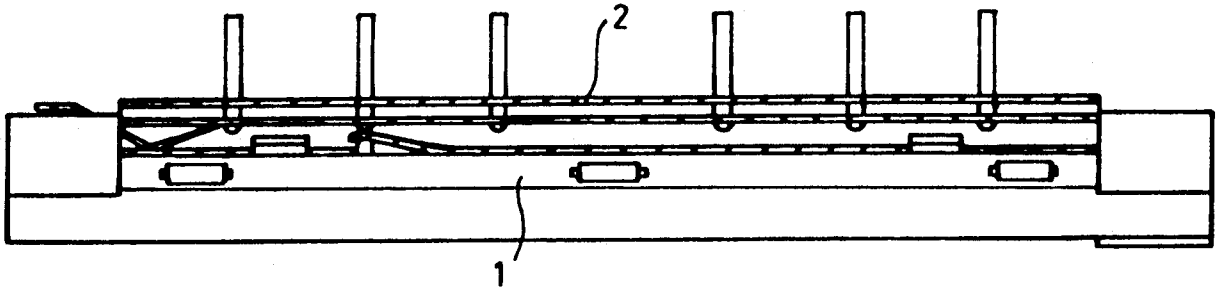
FIG. 3 is a cross-section view of the combination of a mounting seat and a paper-clipping structure in accordance with the present invention.
Figure 4:
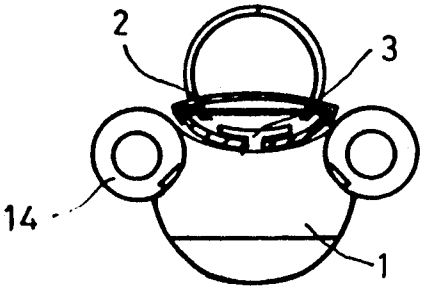
FIG. 4 is another cross-section view of the combination of a mounting seat and a paper-clipping structure in accordance with the present invention.

Referring to FIG. 1, the paper-clipping structure 2 is a conventional type in which a fastening slot 22, a guiding plate 23, a narrow slot 24 and a guiding slot 25 are provided in the rear surface at one end of the paper-clipping structure 2. Another fastening slot 22 and narrow slot 24 are provided at the other end of structure 2. The fastening slots 22 correspond to the fastening plates 12 of the mounting seat 1. Referring to FIG. 2, is can be seen that a paper-clipping structure 2 is provided with a screw hole 11 at each end of the mounting seat 1. As shown in FIGS. 3 and 4, a screw or rivet 3 passes through hole 21 and secures with hole 11 of the paper-clipping structure 2. In another type of fastening method, the fastening slot 22 is inserted into the end portion of the fastening plate 12 and then securely mounted by moving the paper-clipping structure 2 in a longitudinal direction. As show in FIG. 5, the screw hole 11 is designed in such a way that the base of the hole 11 is provided with an upwardly protruding sharp point 111. The sharp point 111 is receivable within the recess 32 of a rivet 3. The forcing in of the rivet 3 will enable the rivet 3 to be securely engaged with the mounting seat 1 due to the expansion of the lower section of the rivet 3. As a result, the paper-clipping structure 2 will be engaged with the mounting seat 1 and prevented from dislocation therefrom.

In another type of paper-clipping structure 2 where no screw holes are provided at the opposite ends thereof, the way of combination is to use slots 22 of the paper-clipping structure 2 for engaging the fastening plates 12 of the mounting seat 1. At the same time, the plate 23 matches with the protrusion 13. The paper-clipping structure 2 is moved longitudinally, such that the protrusion 13 will slide in a direction opposite to the movement direction, and each fastening plate 12 will exactly fasten within a small slot 24. At this moment, the protrusion 13 will engage within the slot 25 so that the paper-clipping structure 2 will become securely mounted to the mounting seat 3. FIGS. 3 and 4 are cross-section views of the combination of a mounting seat 1 and a paper-clipping structure 2 in accordance with the present invention.

Figure 6:
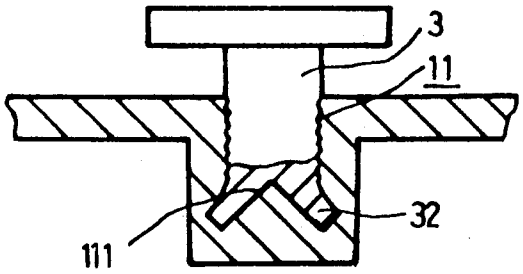
FIGS. 5 and 6 are cross section views illustrating the mounting of a rivet into a screw hole of the mounting seat in accordance with the present invention, wherein the base of the screw hole has a sharp conical point.
Figure 5:
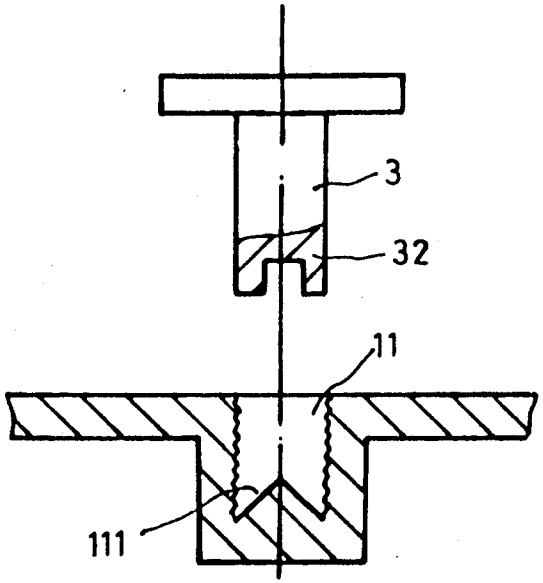
Figure 7:
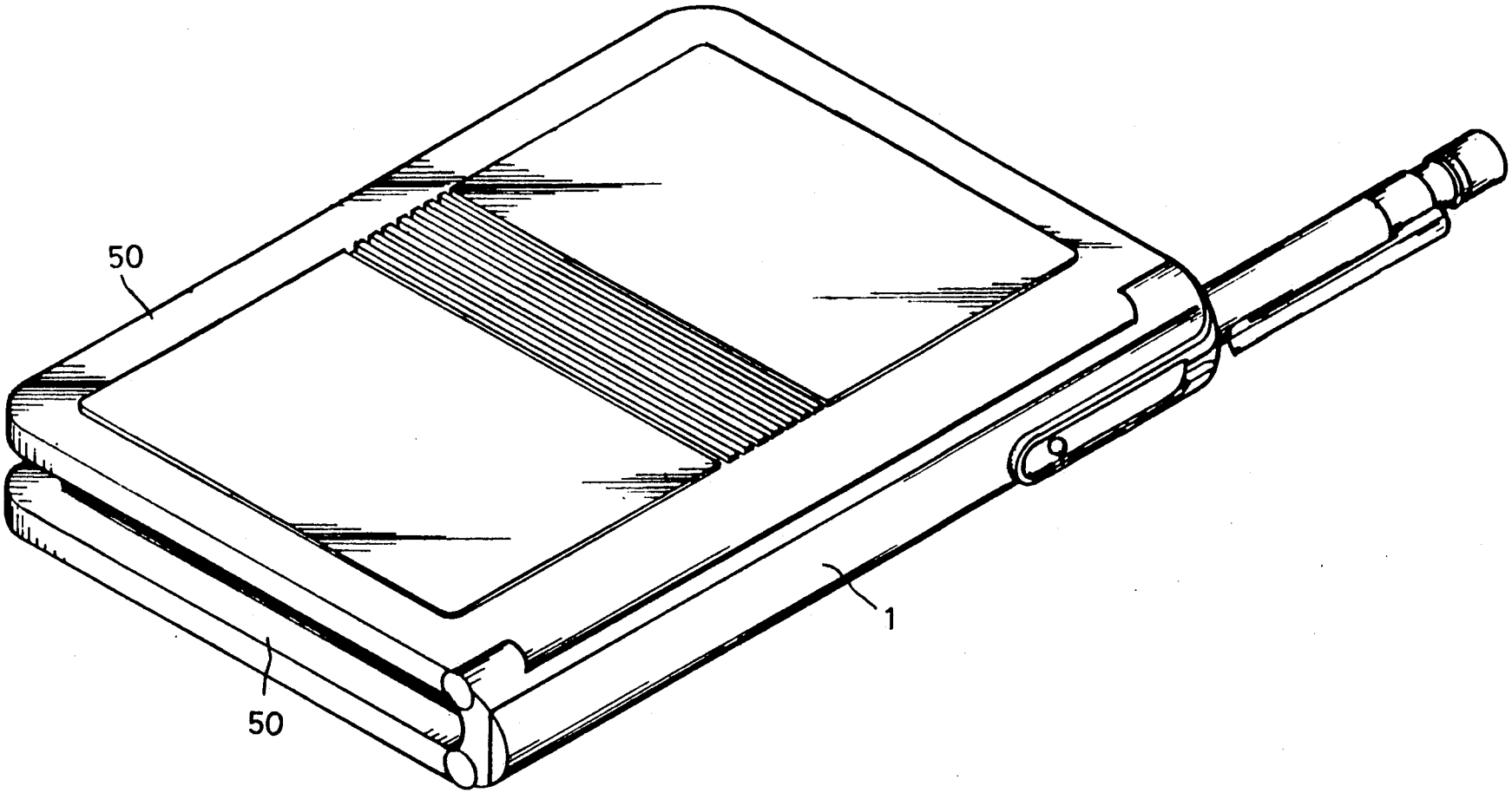
FIG. 7 is a perspective view of the invention.

FIGS. 5 and 6 are cross section views illustrating the mounting of rivet into the screw hole of the mounting seat in accordance with the present invention. It can be seen that the rivet 3 has a recess 32 at the lower section thereof and the base of the screw hole has a sharp conical point 111. The forcing in of the rivet 3 will force the recess 32 to deform in accordance with the sharp point 111. Such a deformation will enable the rivet 3 to fasten the paper-clipping structure 2 to the mounting seat 1.

While the invention has been described with respect to certain preferred embodiments, they are not intended to limit the scope of the invention.

I claim:

1. A mounting seat and paper clipping structure assembly for the hard covers of a paper file comprising:

a) a mounting seat in the form of a substantially narrow plate having opposite ends, a screw hole formed in each end, a fastening plate positioned adjacent each screw hole, each screw hole and fastening plate being positioned along a longitudinal axis of the mounting seat, and a protrusion positioned adjacent one of the fastening plates;

b) a paper clipping structure in the form of a substantially narrow strip having opposite ends, a screw hole provided in each opposite end, the screw holes of the paper clipping structure corresponding in position to the screw holes of the mounting seat;

c) a pair of rivets for securing the mounting seat to the paper clipping structure through the corresponding screw holes;

d) the mounting seat including four corners, a hollow tubular element being provided at each corner and extending axially along the longitudinal axis of the mounting seat; and e) a tapered peg insertable within each hollow tubular element for securing the hard covers to the mounting seat.

2. The assembly of claim 1 wherein each screw hole includes a closed base and includes a protruding sharp point extending upwardly from the base within the hole.

3. A mounting seat and paper clipping structure assembly for the hard covers of a paper file comprising:

a) a mounting seat in the form of a substantially narrow plate having opposite ends, a screw hole formed in each end, a fastening plate positioned adjacent each screw hole, each screw hole and fastening plate being positioned along a longitudinal axis of the mounting seat, and a protrusion positioned adjacent one of the fastening plates;

b) a paper clipping structure in the form of a substantially narrow strip having a rear surface, a pair of spaced fastening slots provided in the rear surface and corresponding in position to the fastening plates, each fastening slot including a narrow slot, a guiding plate provided at one of the fastening slots, and the guiding plate including a guiding slot, whereby the paper clipping structure is secured to the mounting seat by engaging the pair of fastening plates within the pair of fastening slots, the protrusion within the guiding slot and moving the paper clipping structure longitudinally relative to the mounting seat;

c) the mounting seat including four corners, a hollow tubular element provided at each corner and extending axially along the longitudinal axis of the mounting seat; and d) a tapered peg insertable within each hollow tubular element for securing the hard covers to the mounting seat.

* * * * *